US006994235B2

(12) United States Patent
Damrath et al.

(10) Patent No.: US 6,994,235 B2
(45) Date of Patent: Feb. 7, 2006

(54) APPLIANCE FOR THE SMOOTHING OF SHIRTS

(75) Inventors: Joachim Damrath, Bachhagel (DE); Peter Ehrler, Dresden (DE); Christian Hafer, Erding (DE); Markus Spielmannleitner, Ellwangen (DE); Bodo Urich, Berlin (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 105 days.

(21) Appl. No.: 10/629,149

(22) Filed: Jul. 29, 2003

(65) Prior Publication Data

US 2004/0128874 A1 Jul. 8, 2004

Related U.S. Application Data

(63) Continuation of application No. PCT/EP02/00905, filed on Jan. 29, 2002.

(30) Foreign Application Priority Data

Jan. 29, 2001 (DE) ..... 101 08 648

(51) Int. Cl.
*A41H 5/02* (2006.01)

(52) U.S. Cl. ..... 223/67; 223/70

(58) Field of Classification Search ..... 223/67–70, 223/73, 77, 79–81, 74, 76; 38/1 A, 1 B, 38/1 C, 1 R, 13, 14, 69; 219/211
See application file for complete search history.

(56) References Cited

U.S. PATENT DOCUMENTS

| | | | | |
|---|---|---|---|---|
| 3,048,310 A | * | 8/1962 | Dosal | 223/70 |
| 3,165,244 A | | 1/1965 | Dosal | |
| 3,505,743 A | | 4/1970 | Radford et al. | |
| 3,613,969 A | * | 10/1971 | Forse | 223/37 |
| 3,653,561 A | | 4/1972 | Shields | |
| 4,538,054 A | | 8/1985 | De la Bretonière | |

* cited by examiner

*Primary Examiner*—Gary L. Welch
(74) *Attorney, Agent, or Firm*—John T. Winburn; Russell W. Warnock; Craig J. Loest

(57) ABSTRACT

To smooth items of clothing, especially shirts, by an inflatable bag, the item of clothing, especially in a damp state, is placed on the inflatable bag, is pulled taut by the inflation of the bag, and is dried by heat. To this end, the inflatable bag is inflated with heated air, certain areas of the item of clothing drying faster than others however. To supply heat energy in a targeted manner to individual, especially slow-drying areas, the inflatable bag includes heating bodies either supplying additional heat for drying the item of clothing, or all of the heat. Advantageously, the heating bodies are applied to the material of inflatable bag.

17 Claims, 2 Drawing Sheets

APPLIANCE FOR THE SMOOTHING OF SHIRTS

CROSS-REFERENCE TO RELATED APPLICATION

This application is a continuation of copending International Application No. PCT/EP02/00905, filed Jan. 29, 2002, which designated the United States and was not published in English.

BACKGROUND OF THE INVENTION

Field of the Invention

The invention relates to an appliance for the smoothing of shirts, in particular, for smoothing the ends of the shirt sleeves and the cuffs, the shirt collar, and the button tapes.

According to a prior art method, shirts are smoothed by being fixed at various points and being inflated, in particular, by warmed air and tensioned, while the shirt may, additionally, be drawn apart at the fixed points.

In another method for the smoothing of shirts, an inflatable swelling bag is used, around which the shirt is disposed. In such a case, the shirt does not have to be fixed because the swelling bag holds it. The cuffs, are in these cases, smoothed by sleeve portions of the swelling bag. When a swelling bag is used, it is known to fix the button tape and also the sleeves or the collar of the shirt to be smoothed so as not to have to button it up, as is disclosed, for example, from U.S. Pat. No. 3,165,244 to Dosal.

When such a swelling bag is used, however, there is the problem that, although the surface of the swelling bag is warmed uniformly by the warmed air flowing in, nevertheless, individual points on a shirt to be smoothed, at which thicker material is used or the material is a multi-ply, such as, for example, the cuffs, the collar, or the button tape, are not sufficiently smoothed because the warmed air cannot generate sufficient warmth at these points. Likewise, however, a more pronounced warming of the air to be supplied or a longer treatment of the shirt to be smoothed would lead, inter alia, to an overloading of the shirt in the remaining regions.

SUMMARY OF THE INVENTION

It is accordingly an object of the invention to provide an appliance for the smoothing of shirts that overcomes the hereinafore-mentioned disadvantages of the heretofore-known devices of this general type and in which the cuffs and the collar or the button tape and also the shirt as a whole are smoothed satisfactorily.

With the foregoing and other objects in view, there is provided, in accordance with the invention, an appliance for the smoothing of shirts has an inflatable shirt-shaped swelling bag with a body portion, two sleeve portions, and a collar portion and partially or continuously has heating bodies.

What is achieved by providing heating bodies in the entire shirt-shaped swelling bag is that a smoothing of the shirt is ensured even in the event of lesser or no warming of the air introduced into the swelling bag. Thus, the duration of the introduction of warm air into the swelling bag can be reduced, as compared with conventional appliances, because sufficient energy is generated by the provision of the heating bodies in order, thereby, to smooth the shirts.

What is achieved by the provision of heating bodies in defined regions of the swelling bag is that, in these regions, the shirt experiences, in addition to the energy emitted by the warmed air introduced, a supply of energy through the heating bodies, the shirt being sufficiently smoothed as a result. In accordance with another feature of the invention, the heating bodies are implemented in the form of heating filaments that are glued on or are woven into the cloth of the swelling bag. The glued-on heating filaments may be attached on the inside of the swelling bag and on the outside of the swelling bag.

In accordance with a further feature of the invention, the heating filaments are embroidered into the swelling bag.

In accordance with an added feature of the invention, the heating filaments are applied to the cloth.

In accordance with an additional feature of the invention, the heating bodies heat with different radiant-heating capacities in different regions of the bag.

In general, different radiant-heating capacities may be achieved by a different activation of various heating devices and/or by the provision of heating devices with different radiant-heating capacities, for example, by heating filaments that are laid more or less close together. The regions in which the shirt dries more slowly can, consequently, be heated to a greater extent in a controlled manner. Furthermore, the cut or the type of the shirt can, consequently, also be taken into account, for example, if the shirt has breast pockets or appliqué work or additional cloth layers at specific points.

The heating of the swelling bag may also be regulatable or controllable in terms of all the heating devices to take into account different materials so that, for example, where silk is concerned, lower temperatures can be set than in the case of cotton.

In accordance with yet another feature of the invention, advantageously, heating conductors are used, the resistance of which increases sharply at rising temperatures and, particularly, from a specific temperature so that self-regulation of the temperature is achieved. The heat losses in the more rapidly dry regions can, thereby, be limited.

For such a purpose, in accordance with yet a further feature of the invention, the heating bodies may be provided in the region of the collar portion, in the region of the shirt cuffs at the ends of the two sleeve portions, and/or in the region of the button tape and buttonhole tape.

In accordance with yet an added feature of the invention, the energy source of the heating bodies is, preferably, located in the base of the swelling bag, the base also serving as a standing foot for the appliance. The base has, furthermore, a blower and a heating device so that the warmed air can be introduced into the swelling bag.

In accordance with yet an additional feature of the invention, the regions in which the heating filaments are woven in or glued on are air-permeable. What is achieved thereby is that the shirt is warmed and, therefore, smoothed in the immediate vicinity to the collar portion both by the warmed air introduced and by the energy emitted by the heating bodies.

In accordance with again another feature of the invention, the heating bodies are assigned temperature sensors and/or moisture sensors and the temperature of the heating bodies is set as a function of the detected temperature and/or moisture of the shirt portion to be smoothed. It is, thereby, possible to implement a synchronous drying of all the portions of the shirt, overdrying of thin or single-ply portions being avoided.

In accordance with again a further feature of the invention, the heating bodies are electrical resistance heating elements.

In accordance with again an added feature of the invention, the electrical resistance heating elements have a positive temperature coefficient in a temperature range.

With the objects of the invention in view, there is also provided an appliance for smoothing shirts, including an inflatable shirt-shaped, cloth swelling bag having a body portion having a button tape region and a buttonhole tape region, two sleeve portions with ends, a collar portion, and heating filaments at least one of woven into and applied on the cloth of at least one of at the collar portion, at the ends, at the button tape region, and at the buttonhole tape region.

Other features that are considered as characteristic for the invention are set forth in the appended claims.

Although the invention is illustrated and described herein as embodied in an appliance for the smoothing of shirts, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
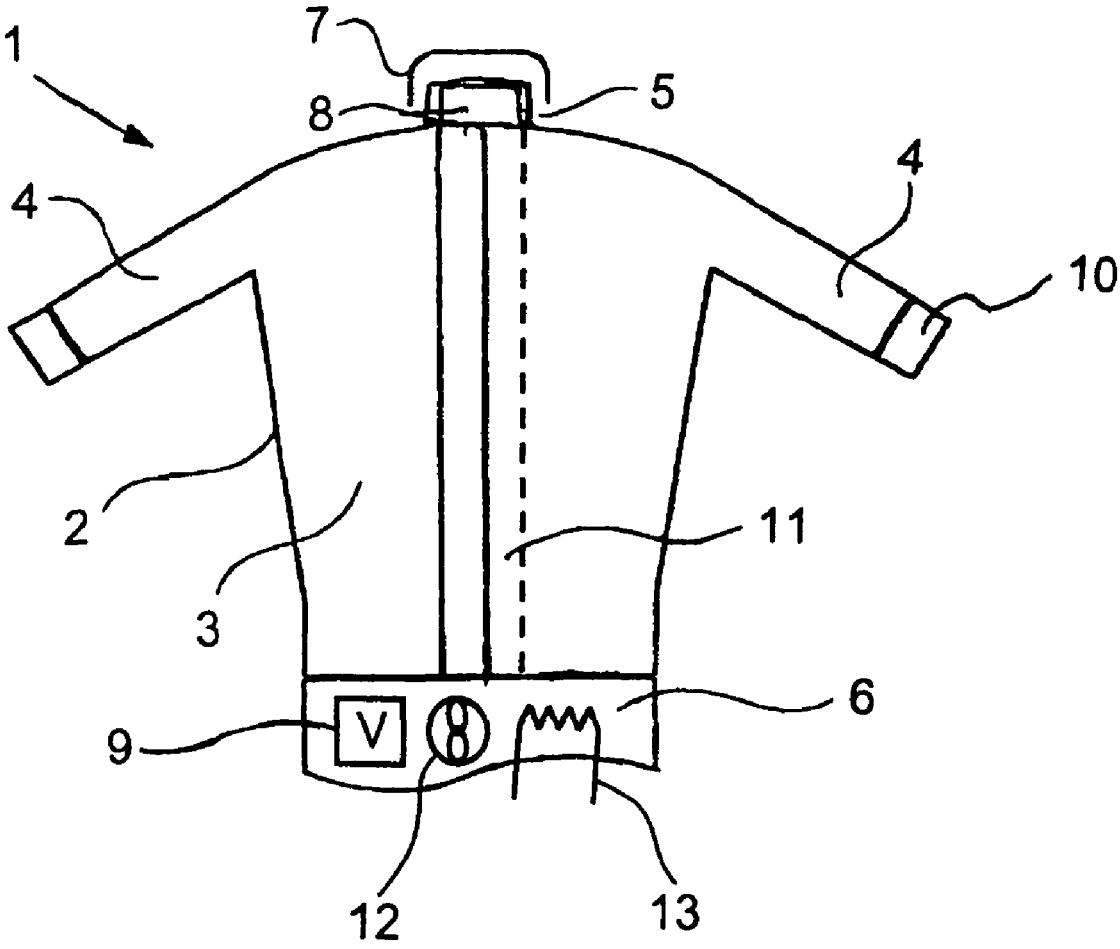
FIG. 1 is a fragmentary elevational view from the front of an appliance according to the invention for the smoothing of shirts.

Referring now to the figures of the drawings in detail and first, particularly to FIG. 1 thereof, there is shown an appliance 1 for the smoothing of shirts, with a swelling bag 2 that is mounted on a base 6, not illustrated in its entirety. The swelling bag 2 has a body portion 3, two sleeve portions 4, and a collar portion 5. The base 6, which also serves as a standing foot for the appliance, has a blower 12 and a heating device 13 so that the swelling bag 2 can be inflated with warm air. In addition, the collar portion 5 has fastened above it an air deflection part 7 that can deflect downward the air emerging from the collar portion, particularly, at the top and can guide the air from outside onto a fixed collar.

Heating bodies 8 in the form of heating filaments are provided in the region of the collar portion 5. In the embodiment shown in FIG. 1, the heating bodies 8 are woven or embroidered into the material of the swelling bag 2, one of which is dashed, thus indicating that the filament is woven. An energy source 9 that supplies the heating bodies 8 with voltage is provided in the base 6. What is achieved thereby, in the case of a shirt laid onto the swelling bag 2, is that the shirt is warmed and, therefore, smoothed in the immediate vicinity of the collar portion 5 both by the warmed air introduced and by the energy emitted by the heating bodies 8.

For the same purpose, heating bodies 10, 11 in the form of heating filaments are provided in the region of the shirt cuffs at the ends of the two sleeve portions 4 and/or in the region of the button tape and buttonhole tape in the body portion 3. These heating bodies 10, 11, too, are woven into the material of the swelling bag 2 and are supplied with voltage by the energy source 9.

Figure 2:
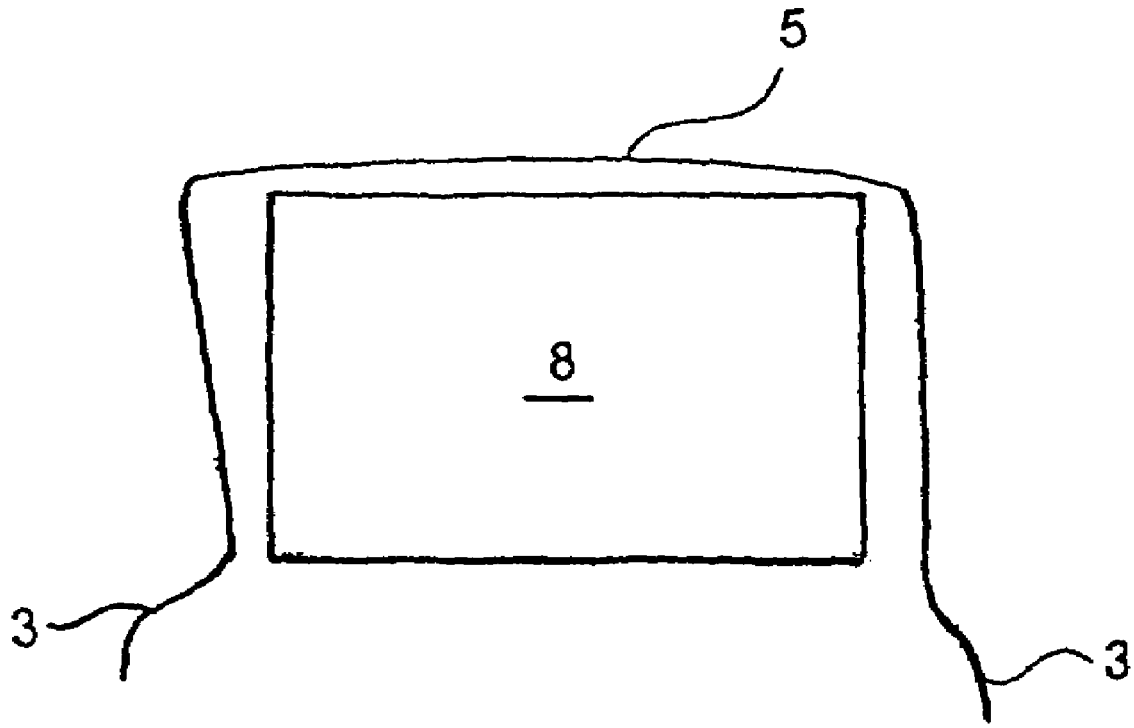
FIG. 2 is a fragmentary, enlarged, side view of the collar portion of the appliance of FIG. 1.

The side view according to FIG. 2 shows the collar portion 5 with heating filaments 8 disposed in it. The air deflection part 7 is not illustrated in the view of FIG. 2. In this preferred embodiment, the heating filaments 8 are provided in the collar portion 5 solely in the regions in which the shirt collar rests against the swelling bag 2.

Preferably, the heating filaments 8 are electrical resistance heating elements having a positive temperature coefficient in a temperature range.

We claim:

1. An appliance for smoothing shirts, comprising:

an inflatable shirt-shaped swelling bag having a bag surface and heating bodies at least one of partially and continuously disposed at said bag surface;

wherein said bag has a body portion, two sleeve portions, and a collar portion; and wherein said heating bodies are disposed in a region of said collar portion.

2. The appliance according to claim 1, wherein:

said sleeve portions have ends; and said heating bodies are disposed in a region of said ends where shirt cuffs are disposed.

3. The appliance according to claim 2, wherein:

said body portion has a button tape region and a buttonhole tape region; and said heating bodies are disposed in a region of said button tape and buttonhole tape regions.

4. The appliance according to claim 1, wherein:

said sleeve portions have ends; and said heating bodies are disposed in a region of said ends where shirt cuffs are disposed.

5. The appliance according to claim 4, wherein:

said body portion has a button tape region and a buttonhole tape region; and said heating bodies are disposed in a region of said button tape and buttonhole tape regions.

6. The appliance according to claim 1, wherein:

said bag has a base; and an energy source is disposed in said base and is connected to said heating bodies.

7. The appliance according to claim 1, wherein said heating bodies heat with different radiant-heating capacities in different regions of said bag.

8. The appliance according to claim 1, wherein said heating bodies are electrical resistance heating elements.

9. The appliance according to claim 8, wherein said electrical resistance heating elements have a positive temperature coefficient in a temperature range.

10. An appliance for smoothing shirts, comprising:

an inflatable shirt-shaped swelling bag having a bag surface and heating bodies at least one of partially and continuously disposed at said bag surface; and wherein said heating bodies are heating filaments.

11. The appliance according to claim 10, wherein:

said swelling bag is of cloth; and said heating filaments are woven into said cloth.

12. The appliance according to claim 11, wherein said heating filaments are embroidered into said swelling bag.

13. The appliance according to claim 10, wherein: said swelling bag is of cloth; and said heating filaments are applied to said cloth.

14. The appliance according to claim 10, wherein said heating filaments are applied to said cloth on an inside of said bag.

15. The appliance according to claim 10, wherein said heating filaments are applied to said cloth on an outside of said bag.

16. An appliance for smoothing shirts, comprising:

an inflatable shirt-shaped swelling bag having a bag surface and heating bodies at least one of partially and continuously disposed at said bag surface; and at least one of temperature sensors and moisture sensors connected to said heating bodies, a temperature setting of said heating bodies being set as a function of at least one of a detected temperature and a detected moisture of a shirt portion to be smoothed.

17. An appliance for smoothing shirts, comprising:

an inflatable shirt-shaped, cloth swelling bag having:

a body portion having a button tape region and a buttonhole tape region;

two sleeve portions with ends;

a collar portion; and heating filaments at least one of woven into and applied on said cloth of at least one of:

at said collar portion;

at said ends;

at said button tape region; and at said buttonhole tape region.

* * * * *